US010024280B2

(12) United States Patent
Anma et al.

(10) Patent No.: US 10,024,280 B2
(45) Date of Patent: Jul. 17, 2018

(54) VESSEL

(71) Applicant: YAMAHA HATSUDOKI KABUSHIKI KAISHA, Iwata-shi, Shizuoka (JP)

(72) Inventors: Hirofumi Anma, Shizuoka (JP); Kenichi Otsuka, Shizuoka (JP); Satoru Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/641,372

(22) Filed: Jul. 5, 2017

(65) Prior Publication Data

US 2018/0058400 A1 Mar. 1, 2018

(30) Foreign Application Priority Data

Aug. 25, 2016 (JP) ..... 2016-164977

(51) Int. Cl.
*B63H 11/04* (2006.01)
*F02M 35/10* (2006.01)
*F04F 5/24* (2006.01)

(52) U.S. Cl.
CPC ..... *F02M 35/10268* (2013.01); *B63H 11/04* (2013.01); *F02M 35/10124* (2013.01); *F04F 5/24* (2013.01); *B63B 2751/00* (2013.01); *B63B 2758/00* (2013.01)

(58) Field of Classification Search
CPC ..... B63H 11/04
USPC ..... 440/88; 114/55
See application file for complete search history.

(56) References Cited

U.S. PATENT DOCUMENTS 5,237,950 A * 8/1993 Abe ..... B63B 35/731 114/363
5,340,344 A * 8/1994 Mineo ..... B63J 2/06 114/55.53
5,490,474 A * 2/1996 Ikeda ..... B63B 35/731 114/343
5,586,922 A * 12/1996 Kobayashi ..... B63B 35/731 114/55.5
5,957,072 A * 9/1999 Hattori ..... B63B 35/731 114/55.57
6,139,381 A * 10/2000 Suzuki ..... F02B 61/045 114/55.51
6,276,290 B1 * 8/2001 Yamada ..... B63B 19/14 114/55.51
6,435,119 B1 * 8/2002 Pelletier ..... B63B 29/04 114/363

(Continued)

FOREIGN PATENT DOCUMENTS

JP 2000-62697 A 2/2000
JP 2009-220637 A 10/2009

*Primary Examiner* — S. Joseph Morano
*Assistant Examiner* — Jovon E Hayes
(74) *Attorney, Agent, or Firm* — Keating and Bennett, LLP

(57) ABSTRACT

A vessel includes a vessel body, an engine contained in the vessel body, an air intake box including an air intake port and that is attached to the engine, an air intake duct drawn around in the vessel body, and a guide duct including an opening that opposes the air intake port. The air intake box supplies air taken in from the air intake port to the engine. The air intake duct includes an outer end connected to a deck of the vessel body. The guide duct guides air taken in from outside the vessel body by the air intake duct to the opening.

15 Claims, 13 Drawing Sheets

(56) References Cited

U.S. PATENT DOCUMENTS

| | | | | |
|---|---|---|---|---|
| 6,435,924 | B2 * | 8/2002 | Ishino | B63J 2/06 114/55.51 |
| 6,471,557 | B1 * | 10/2002 | Hattori | B63B 35/731 114/55.53 |
| 6,471,558 | B1 * | 10/2002 | Nakatsuji | B63J 2/06 114/5 |
| 6,551,156 | B2 * | 4/2003 | Nakamura | F01N 13/004 114/55.5 |
| 6,918,348 | B2 * | 7/2005 | Matsuda | B63B 29/04 114/363 |
| 7,056,171 | B2 * | 6/2006 | Matsuda | B63B 35/731 440/88 A |
| 7,247,067 | B2 * | 7/2007 | Mashiko | F02M 35/10032 440/88 A |
| 7,343,906 | B2 * | 3/2008 | Ozawa | B63B 35/731 123/559.1 |
| 7,404,293 | B2 * | 7/2008 | Ozawa | F02B 33/34 123/563 |
| 7,458,868 | B2 * | 12/2008 | Mineo | B63B 35/731 440/88 C |
| 8,499,788 | B2 * | 8/2013 | Raymo, Sr. | F02M 25/0854 123/519 |
| 2009/0229691 | A1 * | 9/2009 | Miura | B60K 15/03519 137/625 |

* cited by examiner

VESSEL

BACKGROUND OF THE INVENTION

1. Field of the Invention

The present invention relates to a vessel including an engine.

2. Description of the Related Art

A small-sized vessel disclosed in Japanese Patent Application Publication No. 2009-220637 includes a vessel body having an inboard space in its inside and a jet pump disposed behind the vessel body. The inboard space contains an engine that drives the jet pump, a fuel tank for the engine, and an air intake duct through which air passes between the inboard space and outside the vessel body. The engine is disposed in front of the jet pump, and the fuel tank is disposed in front of the engine. The air intake duct has its outer end attached to a wall surface of the vessel body and its inner end disposed in the inboard space. The outer end of the air intake duct includes an air intake port that opens outwardly from the vessel body. Air outside the vessel body passes through the air intake duct from the air intake port, and flows into the inboard space from an inner end of the air intake duct, and is then supplied to the engine.

In the small-sized vessel disclosed in Japanese Patent Application Publication No. 2009-220637, the inner end of the air intake duct is disposed at a more forward position than the fuel tank in the inboard space. Therefore, air that has been taken into the air intake duct from outside the vessel body and that has reached the inner end flows from a more forward position than the fuel tank toward the engine disposed behind the fuel tank in the inboard space. However, the inboard space is filled with hot air generated by the engine. Therefore, outside air taken therein through the air intake duct is exposed to the hot air, and is then warmed, and reaches the engine. Therefore, there is a concern that the temperature of the intake air of the engine will increase and, correspondingly, the output of the engine will decrease.

SUMMARY OF THE INVENTION

In order to overcome the previously unrecognized and unsolved challenges described above, preferred embodiments of the present invention provide a vessel including a vessel body, an engine contained in the vessel body, an air intake box attached to the engine, an air intake duct drawn around in the vessel body, and a guide duct. The vessel body includes a hull defining a vessel bottom and a deck disposed above the hull. The air intake box includes an air intake port, and supplies air taken in from the air intake port to the engine. The air intake duct includes an outer end connected to the deck. The guide duct includes an opening that opposes the air intake port, and guides air taken in from outside the vessel body by the air intake duct to the opening.

According to this preferred embodiment, air taken in from outside the vessel body by the air intake duct flows through the inside of the air intake duct, and then flows through the inside of the guide duct, and reaches the opening of the guide duct. The opening opposes the air intake port of the air intake box, and therefore air that has reached the opening swiftly flows into the air intake port. Therefore, air outside the vessel body reaches the air intake port of the air intake box without being exposed to hot air generated by the heat of the engine in the vessel body, and hence is supplied to the engine at a temperature that is substantially no different from the outside air temperature. As a result, it is possible to reduce or prevent the temperature of intake air of the engine from being increased.

In a preferred embodiment of the present invention, the vessel may include a connector duct in which the air intake duct and the guide duct are integral with each other, and the connector duct may be drawn around in the vessel body so as to pass through an inside of the vessel body from the outer end and so as to oppose the air intake port.

According to this preferred embodiment, the air intake duct and the guide duct are integral with each other, and therefore the intake air temperature of the engine is prevented from being increased while also reducing the number of components.

In a preferred embodiment of the present invention, the vessel may include two ducts that differ from each other in shape, and one of the two ducts may be the connector duct.

In a preferred embodiment of the present invention, the vessel may include a fuel tank that is disposed at a more forward position than the air intake box in the vessel body and that stores fuel for the engine, and the connector duct may include an upper portion disposed at a higher position than the fuel tank and a turned-up portion disposed at a more forward position than the fuel tank or disposed between the air intake box and the fuel tank, the turned-up portion extending downwardly from the upper portion and then turning upwardly.

According to this preferred embodiment, the turned-up portion is positioned at a higher position than a water surface around the vessel body when the vessel is overturned so as to reverse the up-down direction of the vessel body, and therefore water outside the vessel body cannot pass through the turned-up portion even if this water enters into the connector duct. This makes it possible to prevent water outside the vessel body from entering into the vessel body through the connector duct.

In a preferred embodiment of the present invention, the turned-up portion may include a water drain hole that opens downwardly.

According to this preferred embodiment, even if water outside the vessel body enters into the connector duct, this water is discharged outwardly from the connector duct and from the water extracting hole in the turned-up portion, and therefore it is possible to prevent water from collecting in the connector duct.

In a preferred embodiment of the present invention, the vessel may include a flange that projects from a periphery of the air intake port in the air intake box.

According to this preferred embodiment, it is possible for the flange to reduce or prevent hot air around the engine from entering the air intake port of the air intake box. This makes it possible to further reduce or prevent the temperature of intake air of the engine from being increased.

In a preferred embodiment of the present invention, the air intake duct includes an inner end disposed in the vessel body, and is disposed so as to take air into the inner end from the outer end. On the other hand, the guide duct is connected to the air intake port of the air intake box, and is disposed apart from the air intake duct. Additionally, the guide duct includes an intake port that takes in air that has been taken into the vessel body by the air intake duct.

According to this preferred embodiment, air taken in from outside the vessel body by the air intake duct flows into a region outside the air intake duct in the vessel body from the inner end of the air intake duct. That air is taken into the guide duct from the intake port of the guide duct, and is guided to the air intake port of the air intake box. The opening of the guide duct is connected to the air intake port of the air intake box, and therefore air that has been taken in from outside the vessel body and that has reached the inner end of the air intake duct is taken into the guide duct, and then reaches the air intake port without being exposed to hot air generated by the heat of the engine, and is supplied to the engine from the air intake box. Therefore, it is possible to further restrain the temperature of intake air of the engine from being raised.

In a preferred embodiment of the present invention, the intake port may be disposed at a lower position than a combustion chamber of the engine.

Cold air is liable to gather in a region below the combustion chamber that is a heat source of the engine, and therefore this region is lower in temperature than the surroundings of the combustion chamber. Therefore, air that has been taken in from outside the vessel body and that has reached the region reaches the air intake box from the intake port through the inside of the guide duct without being influenced by the heat of the engine, and is then supplied to the engine. As a result, it is possible to further prevent the temperature of intake air of the engine from being raised.

In a preferred embodiment of the present invention, the vessel may include a flange that projects from a periphery of the intake port in the guide duct.

According to this preferred embodiment, it is possible for the flange to reduce or prevent hot air around the engine from entering the intake port of the guide duct. This makes it possible to further reduce or prevent the temperature of intake air of the engine from being increased.

In a preferred embodiment of the present invention, the air intake duct may include an inner end disposed in the vessel body, and may be disposed so as to take air into the inner end from the outer end. Additionally, the guide duct may be spaced apart from the air intake box and from the air intake duct between the air intake box and the inner end.

According to this preferred embodiment, the guide duct, the air intake box, and the air intake duct are provided independently of each other, and therefore the degree of freedom in designing and disposing these components is increased.

In a preferred embodiment of the present invention, the vessel may include a fuel tank that is disposed at a more forward position than the air intake box in the vessel body and that stores fuel for the engine, and the guide duct may be disposed at a higher position than the fuel tank.

According to this preferred embodiment, the guide duct is drawn around toward a higher position than the fuel tank in the vessel body, and this makes it possible to bring the opening of the guide duct close to the air intake port of the air intake box. Therefore, air that has been taken in from outside the vessel body and that has reached the opening through the inside of the guide duct reaches the air intake port without being influenced by hot air in the vessel body, and is supplied to the engine from the air intake box, and therefore it is possible to further reduce or prevent the temperature of intake air of the engine from being increased.

In a preferred embodiment of the present invention, the vessel may include a heat shield that thermally shields a space between a first region where the engine is disposed in the vessel body and a second region where the air intake box and the opening are disposed in the vessel body.

According to this preferred embodiment, it is possible for the heat shield to reduce or prevent air that has been taken in from outside the vessel body and that has reached the opening through the inside of the guide duct from entering the first region and from being heated by the heat of the engine. Additionally, the heat shield makes it possible to reduce or prevent the hot air of the first region from entering the second region, and therefore it is possible to reduce or prevent an increase in temperature of the second region. Therefore, air that has reached the opening of the guide duct reaches the air intake port without being influenced by heat generated by the engine, and is supplied to the engine from the air intake box. As a result, it is possible to further reduce or prevent the temperature of intake air of the engine from being increased.

In a preferred embodiment of the present invention, the vessel may include a heat insulator with which the air intake box is covered.

According to this preferred embodiment, the air intake box is insulated from ambient hot air by the heat insulator, and therefore it is possible to reduce or prevent the temperature of air supplied to the engine from being increased in the air intake box. This makes it possible to further reduce or prevent the temperature of intake air of the engine from being increased.

In a preferred embodiment of the present invention, the vessel may be a jet propulsion watercraft including a jet pump that generates a jet propulsion force by sucking in and jetting out water by a driving force of the engine.

According to this preferred embodiment, in the jet propulsion watercraft, it is possible to reduce or prevent the temperature of intake air of the engine from being increased. As a result, it is possible to reduce or prevent a reduction in the output of the engine, and therefore it is possible to obtain a large propulsive force.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be hereinafter described in detail with reference to the accompanying drawings.

First Preferred Embodiment

Figure 1:
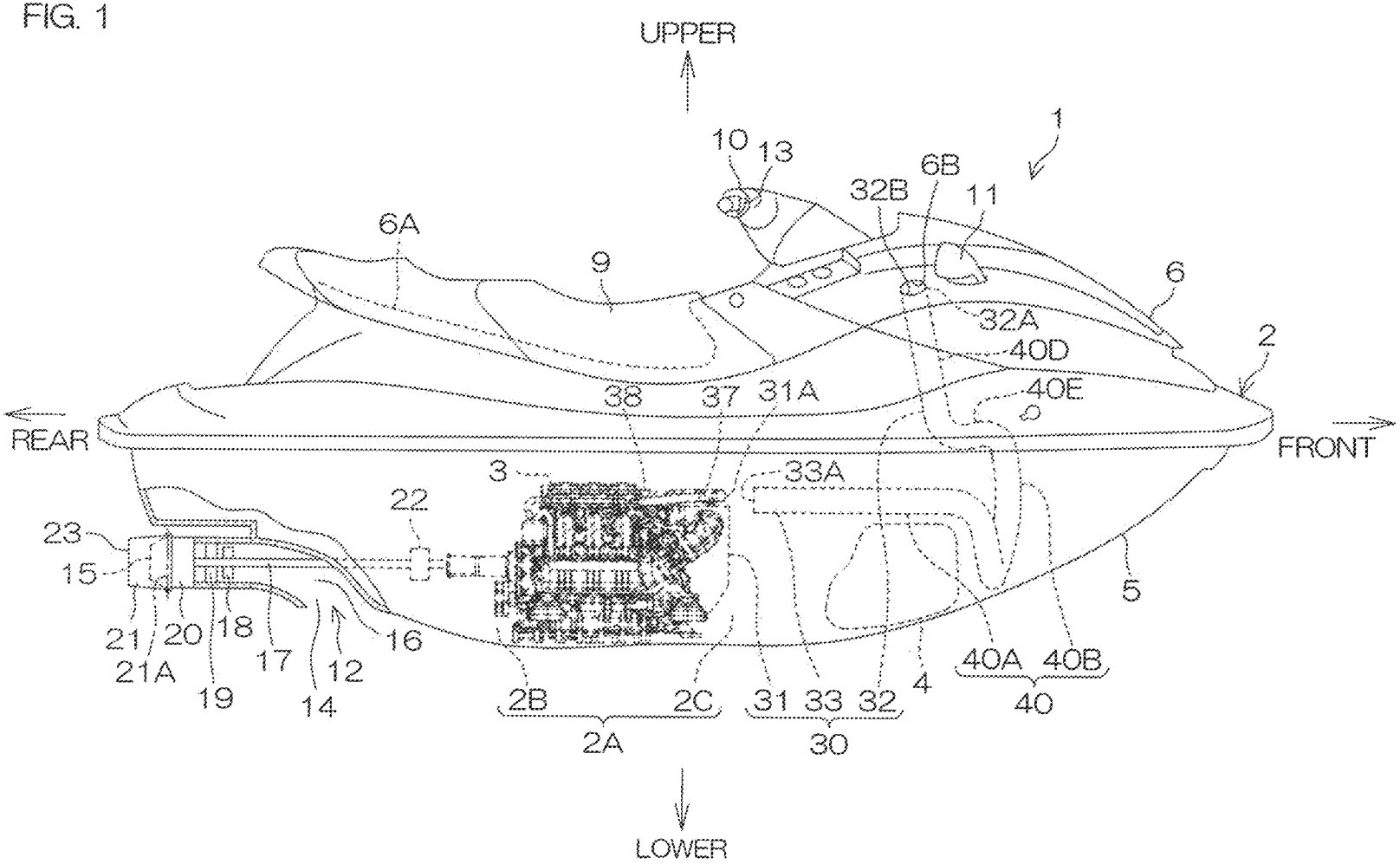
FIG. 1 is a schematic view of a vessel according to a preferred embodiment of the present invention.

FIG. 1 is a schematic view of a vessel 1 according to a preferred embodiment of the present invention. A left-right direction in FIG. 1 is a front-rear direction of the vessel 1. A right side in FIG. 1 is a front side of the vessel 1. In the following description, the left-right direction of the vessel 1 is defined based on when looking toward the front side of the vessel 1. In other words, a near side in the direction perpendicular to the sheet of FIG. 1 is the right side of the vessel 1, whereas a far side in the direction perpendicular to the sheet of FIG. 1 is the left side of the vessel 1.

The vessel 1 includes a vessel body 2, an engine 3, and a fuel tank 4 both of which are contained in the vessel body 2. The vessel body 2 includes a hull 5 defining a vessel bottom and a deck 6 disposed above the hull 5, and extends in the front-rear direction. An internal space 2A is defined inside the vessel body 2. The internal space 2A is defined by the hull 5 and the deck 6 so as to be contained therebetween in the up-down direction, and extends in the front-rear direction in the same way as the vessel body 2. The engine 3 is disposed at a location between the ends of the internal space 2A in the front-rear direction. The engine 3 is preferably an internal combustion engine including a crankshaft (not shown) that rotates around a crankshaft axis (not shown) extending in the front-rear direction. The fuel tank 4 is disposed at a more forward position than the engine 3 in the internal space 2A. Fuel for the engine 3 is stored in the fuel tank 4, and the engine 3 and the fuel tank 4 are connected together through a fuel supply pipe (not shown). The fuel in the fuel tank 4 is supplied to the engine 3 by the fuel supply pipe.

The vessel 1 in the present preferred embodiment is preferably a jet propulsion watercraft, for example. The vessel 1 additionally includes a seat 9 on which a crew member sits, a steering handle 10 operated rightwardly and leftwardly by the crew member, and a jet pump 12 attached to a rear portion of the vessel body 2.

The seat 9 and the steering handle 10 are disposed at a central portion of the deck 6 in the left-right direction. An opening 6A that is open upwardly is provided at an upper portion of the deck 6. The opening 6A is blocked from above by the seat 9 in an ordinary state. When the inside of the vessel body 2 undergoes maintenance, a user or a maintenance operator opens the opening 6A by detaching the seat 9, and accesses the inside of the vessel body 2 from the opening 6A. The engine 3 contained in the vessel body 2 is located below the opening 6A.

The steering handle 10 is disposed at a more forward position than the seat 9. A throttle lever 13 is attached to a right end of the steering handle 10, and a driving force of the engine 3 is adjusted by the operation of the throttle lever 13 by the crew member. A side-view mirror 11 that allows the crew member to see rearwardly is disposed in a more forward region than the steering handle 10 in an upper surface of the deck 6.

The jet pump 12 is disposed at a more rearward position than the engine 3. The jet pump 12 sucks water thereinto from the vessel bottom by the driving force of the engine 3, and jets it rearwardly from the vessel body 2. As a result, the jet pump 12 generates a propulsive force to propel the vessel 1. In detail, the jet pump 12 includes a water intake port 14 through which water of the vessel body 2 is sucked in, a water outlet port 15 through which water sucked in from the water intake port 14 is jetted rearwardly, and a flow passage 16 through which water sucked in through the water intake port 14 is guided to the water outlet port 15. The jet pump 12 additionally includes a drive shaft 17 that extends in the front-rear direction, an impeller 18 and a stationary blade 19 both of which are disposed in the flow passage 16, a nozzle 20, and a deflector 21 that rightwardly and leftwardly deflects a direction in which water is jetted to the rear side from the nozzle 20.

The water intake port 14 is open in the vessel bottom, and the water outlet port 15 is open rearwardly behind the water intake port 14. A front end of the drive shaft 17 is disposed in the vessel body 2, and is connected to a crankshaft (not shown) of the engine 3 through a joint 22 or the like. A rear end of the drive shaft 17 is disposed in the flow passage 16, and is connected to the impeller 18. The stationary blade 19 is disposed behind the impeller 18, and the nozzle 20 is disposed behind the stationary blade 19. The stationary blade 19 and the nozzle 20 are fixed to the flow passage 16.

The impeller 18 is rotatable around a central axis of the drive shaft 17 in the flow passage 16. The impeller 18 is rotationally driven by the engine 3 around the central axis of the drive shaft 17 together with the drive shaft 17. When the impeller 18 is rotationally driven, water outside the vessel body 2 is sucked into the flow passage 16 from the water intake port 14, and is sent to the stationary blade 19 from the impeller 18. Water that has been sent by the impeller 18 passes through the stationary blade 19, and, as a result, water-flow torsion caused by the rotation of the impeller 18 is reduced, and a water flow is straightened. Therefore, water that has been straightened is sent to the nozzle 20 from the stationary blade 19. The nozzle 20 preferably has a cylindrical shape extending in the front-rear direction, and the water outlet port 15 is located in a rear end of the nozzle 20. Therefore, water that has been sent to the nozzle 20 is jetted rearwardly from the water outlet port 15 of the rear end of the nozzle 20.

The deflector 21 extends rearwardly from the nozzle 20. The deflector 21 is connected to the nozzle 20 so as to be rotatable rightwardly and leftwardly around a deflector axis 21A extending in the up-down direction. The deflector 21 is hollow. The water outlet port 15 of the nozzle 20 is disposed in the deflector 21. The deflector 21 includes a jet port 23 that opens rearwardly. The jet port 23 is disposed behind the water outlet port 15. Water that has been jetted rearwardly from the water outlet port 15 passes through the inside of the deflector 21, and is jetted rearwardly from the jet port 23. The deflector 21 turns rightwardly and leftwardly in accordance with the operation of the steering handle 10. As a result, the direction of water jetted from the jet pump 12 is changed rightwardly and leftwardly by the operation of the steering handle 10, and therefore the vessel 1 is steered.

The vessel 1 additionally includes an air intake structure 30 to supply air outside the vessel body 2 to the engine 3. The air intake structure 30 is disposed in the vessel body 2.

The air intake structure 30 includes an air intake box 31, an air intake duct 32, and a guide duct 33.

Figure 2:
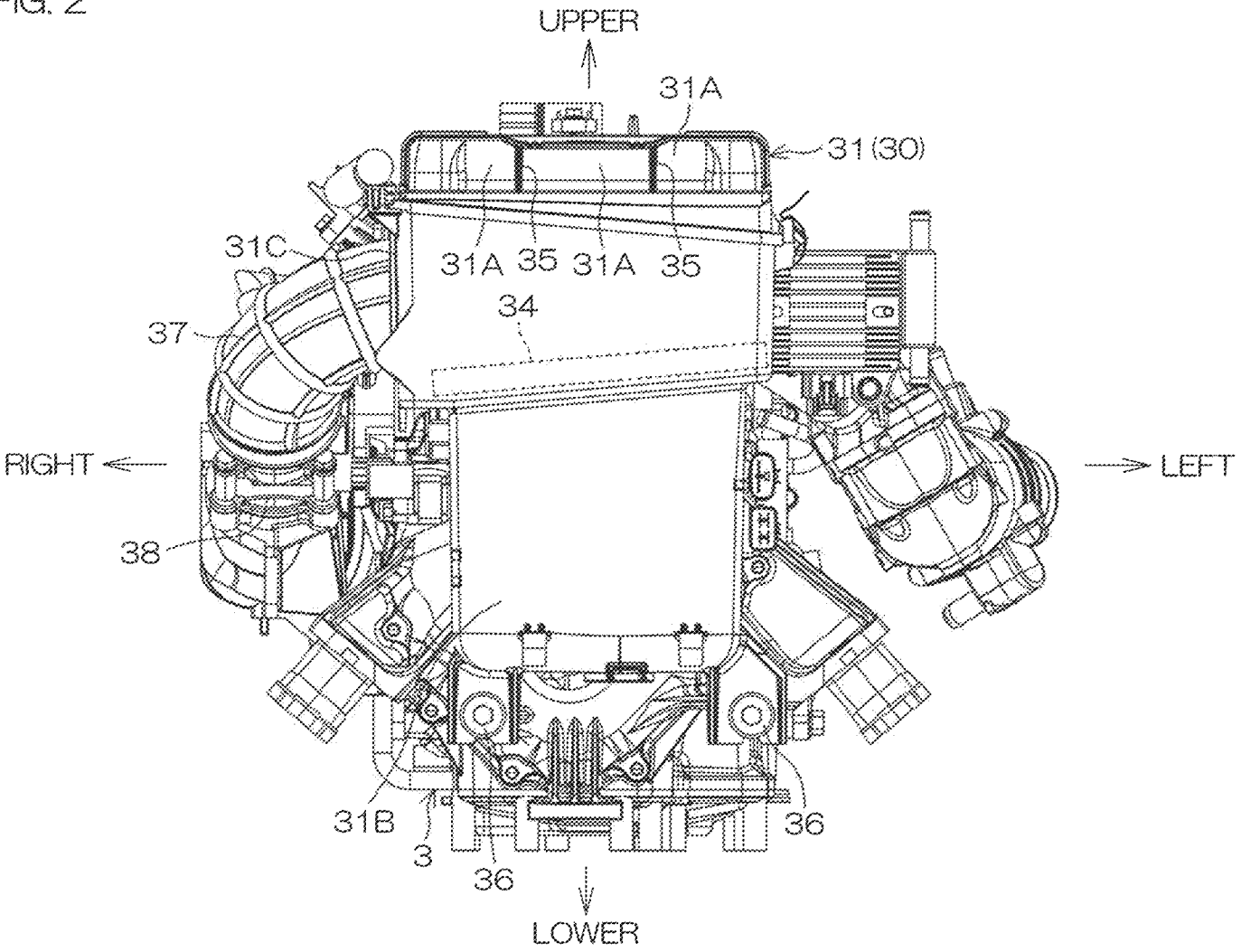
FIG. 2 is a front view of an engine and an air intake box, both of which are included in the vessel.

FIG. 2 is a front view of the engine 3 and the air intake box 31. The air intake box 31 is, for example, made of a resinous material and is hollow. The air intake box 31 includes a built-in filter 34 to purify air. An air intake port 31A to take air around the air intake box 31 into the air intake box 31 is located at an upper end of a front surface 31B of the air intake box 31. The air intake port 31A is slender and extends in the left-right direction, and leads to the inside of the air intake box 31. A plate-shaped partition 35 that is thin in the left-right direction may be provided at a location between the ends of the air intake port 31A in the left-right direction. Air taken into the air intake box 31 from the air intake port 31A is purified by the filter 34.

Figure 3:
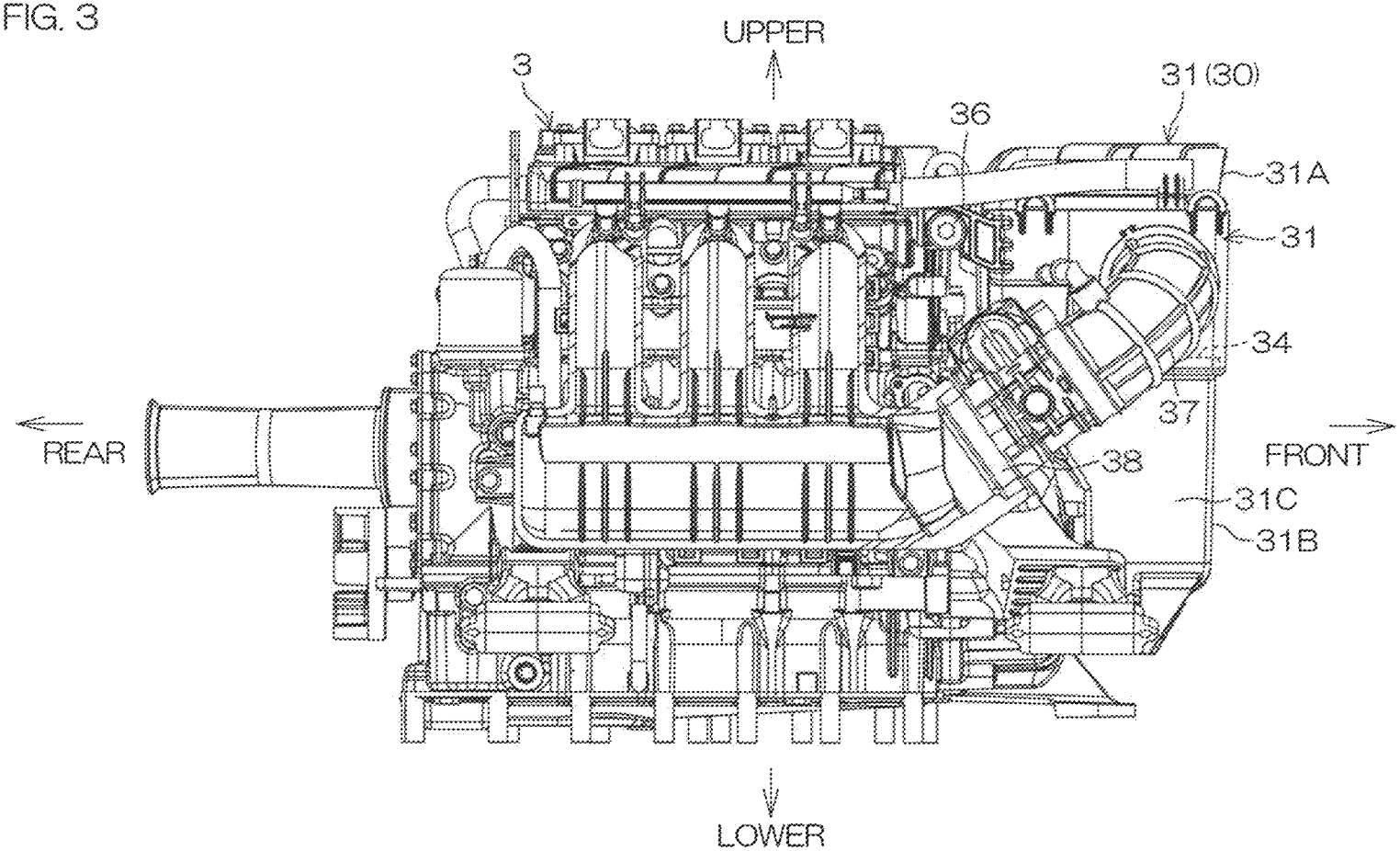
FIG. 3 is a side view of the engine and the air intake box.

FIG. 3 is a right side view of the engine 3 and the air intake box 31. The air intake box 31 is attached to the engine 3 from the front, and is fixed to the engine 3 by a fastening member 36 such as a bolt (see also FIG. 2). The air intake box 31 in this state is disposed at a more rearward position than the fuel tank 4 (see FIG. 1). An air intake pipe 37 made of a flexible material, such as rubber or resin, extends, for example, rightwardly from a right surface 31C of the air intake box 31, and extends rearwardly in a curved manner. In relation to the air intake pipe 37, a throttle body 38 to adjust the amount of air supplied to the engine 3 is disposed at a right surface of the engine 3, and a rear end of the air intake pipe 37 is connected to the throttle body 38. Therefore, air that has been taken in from the air intake port 31A and that has been purified by the filter 34 in the air intake box 31 passes through the air intake pipe 37 and is supplied to the engine 3 through the throttle body 38.

With reference to FIG. 1, the air intake duct 32 and the guide duct 33 each preferably have the shape of a tube and made of a flexible material. In relation to the air intake duct 32, a vent hole 6B is located at a more forward position than the steering handle 10 in the upper surface of the deck 6. The vent hole 6B in the present preferred embodiment preferably includes a pair of vent holes, and these vent holes 6B are arranged side by side in the left-right direction so as to be symmetrical with respect to the center of the vessel body 2 in the left-right direction. The air intake duct 32 includes an outer end 32A connected to either of the pair of vent holes 6B (in the present preferred embodiment, right vent hole 6B) in the deck 6, and is drawn around in the vessel body 2 from the outer end 32A. An entrance 32B that leads the inside of the air intake duct 32 from the vent hole 6B to the outside of the vessel body 2 is provided at an upper end of the outer end 32A. The guide duct 33 extends rearwardly toward the air intake box 31. An opening 33A opposing the air intake port 31A of the air intake box 31 from the front is provided at a rear end of the guide duct 33.

Figure 4:
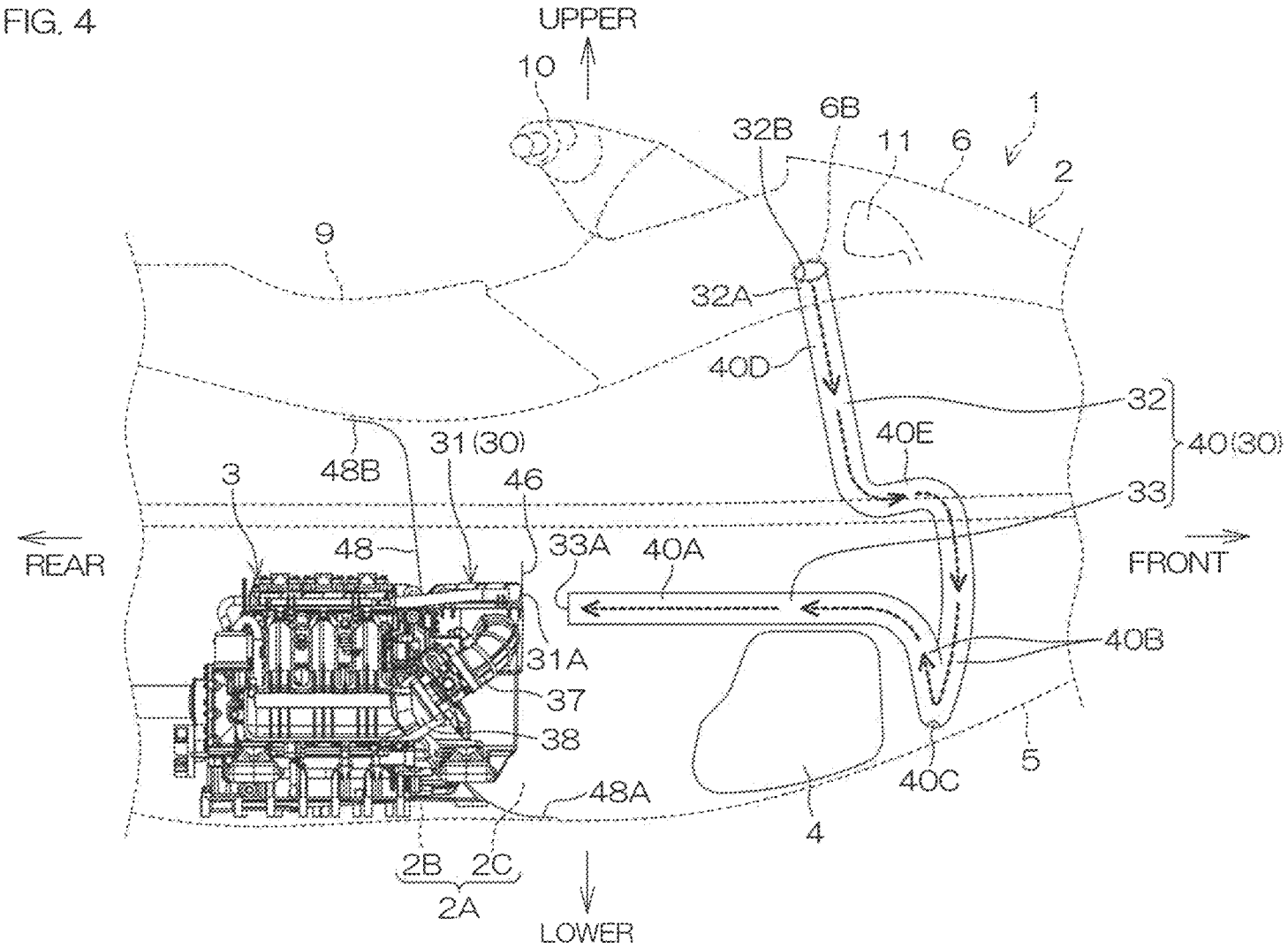
FIG. 4 is a side view of the engine and an air intake structure according to a first example of a preferred embodiment of the present invention.
Figure 5:
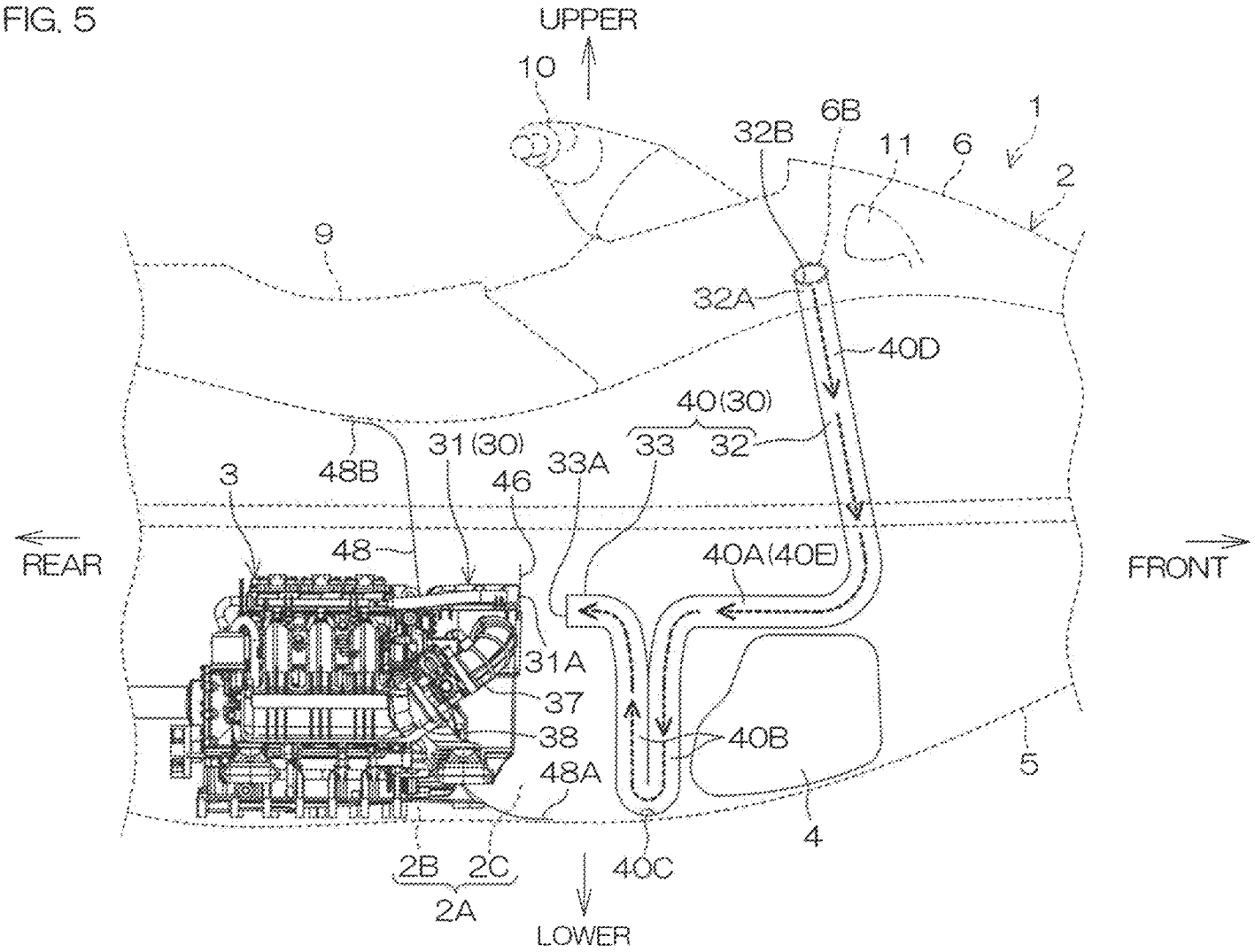
FIG. 5 is a side view of the engine and an air intake structure according to a second example of a preferred embodiment of the present invention.
Figure 6:
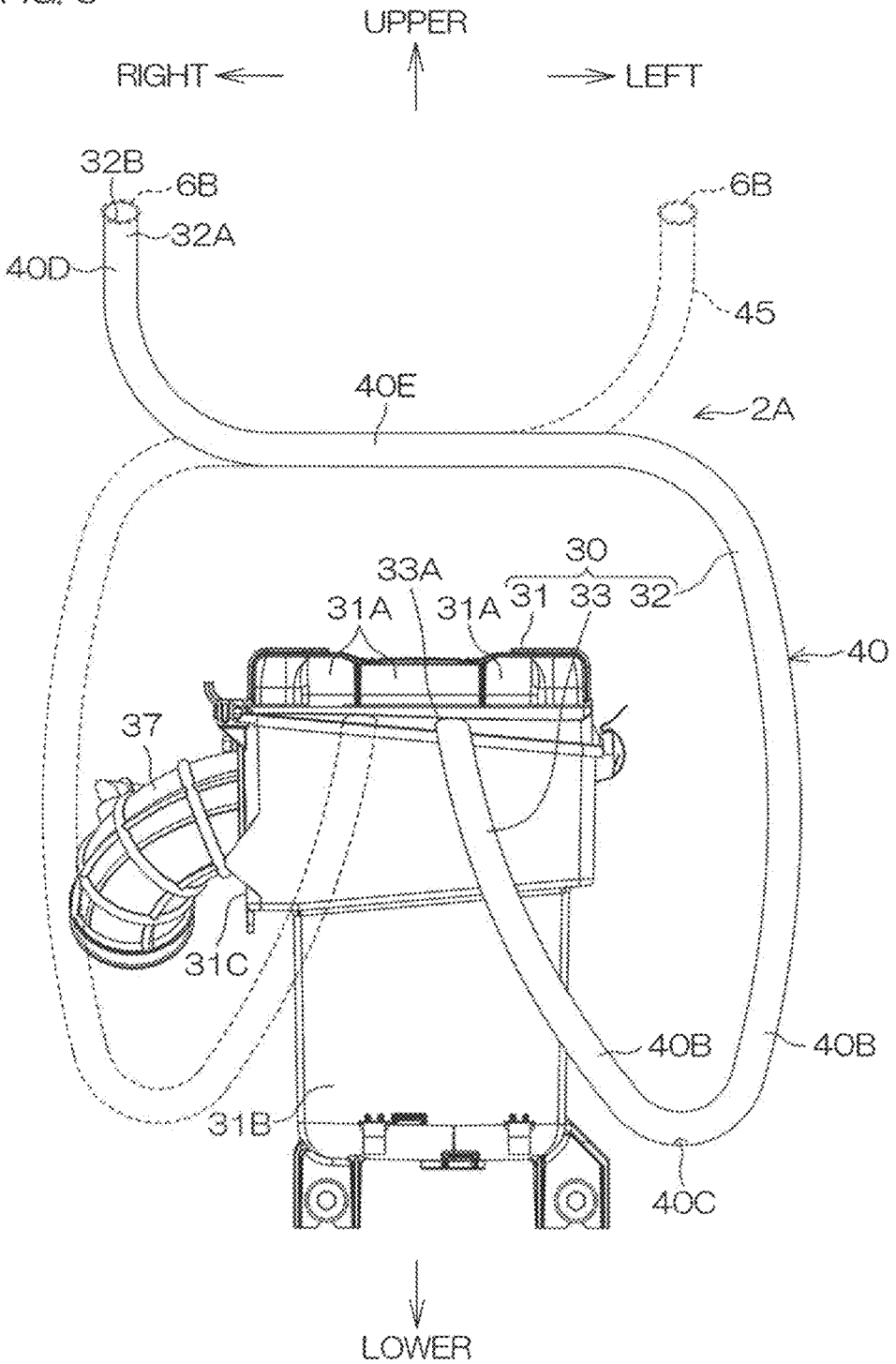
FIG. 6 is a front view of the air intake structure according to the first example or the second example of a preferred embodiment of the present invention.
Figure 7:
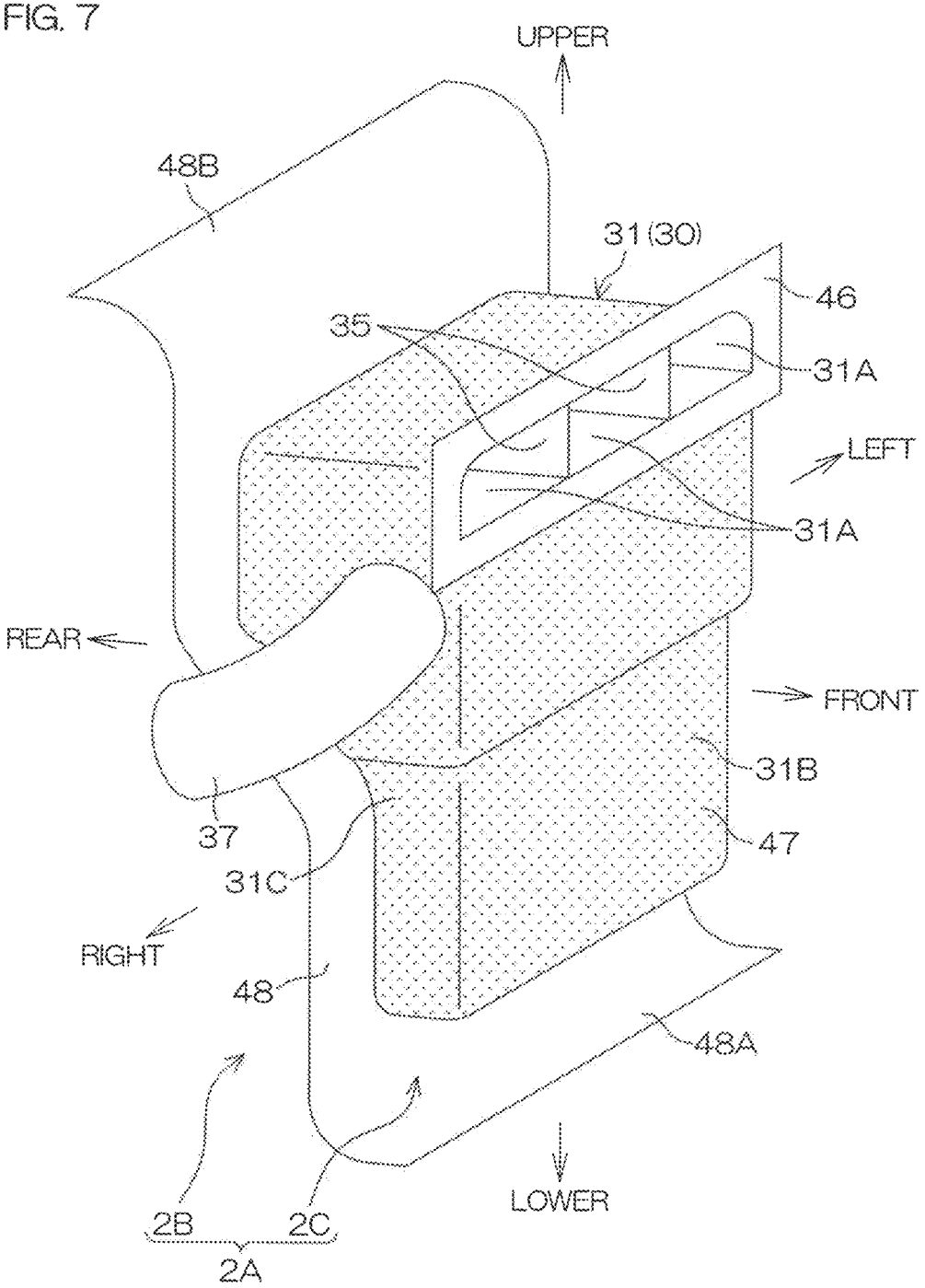
FIG. 7 is a perspective view of the air intake box.

The following first to seventh examples are variations of the configuration of the air intake structure 30. FIG. 4 and FIG. 5 are right side views of air intake structures 30 according to the first and second examples, respectively. FIG. 6 is a front view of the air intake structures 30 according to the first and second examples. FIG. 7 is a perspective view of the air intake box 31 seen from the front. FIG. 8 to FIG. 12 are right side views of air intake structures 30 according to the third to seventh examples, respectively. The air intake structure 30 according to the first example is shown in FIG. 1.

In the first example shown in FIG. 4, the air intake duct 32 and the guide duct 33 are each a portion of a single connector duct 40. Therefore, the number of components is reduced. In the connector duct 40, an upstream portion containing the outer end 32A is the air intake duct 32, and a downstream portion where the opening 33A is provided is the guide duct 33. The connector duct 40 is fixed to the deck 6 in the vent hole 6B, and is drawn around in the vessel body 2 so as to oppose the air intake port 31A through the inside of the vessel body 2 from the outer end 32A. The opening 33A is disposed at substantially the same position as the air intake port 31A in the up-down direction, and is directed from the front toward the air intake port 31A with a gap therebetween.

The connector duct 40 includes an integral upper portion 40A disposed at a higher position than the fuel tank 4 and an integral turned-up portion 40B that extends downwardly from the upper portion 40A and then turns upwardly. The turned-up portion 40B is located at a higher position than a water surface around the vessel body 2 when the vessel 1 is overturned so as to reverse the up-down direction of the vessel body 2. As a result, water outside the vessel body 2 cannot pass through the turned-up portion 40B even if this water infiltrates into the connector duct 40 from the vent hole 6B. This makes it possible to prevent water outside the vessel body 2 from infiltrating into the vessel body 2 through the connector duct 40.

In the first example, the turned-up portion 40B is disposed at a more forward position than the fuel tank 4. In the second example shown in FIG. 5, which is a modification of the first example, the turned-up portion 40B may be disposed between the air intake box 31 and the fuel tank 4. In each air intake structure 30 of the first and second examples, a water drain hole 40C that is open downwardly is located in a lower end of the turned-up portion 40B. Even if water outside the vessel body 2 infiltrates into the connector duct 40, this water is discharged outwardly from the connector duct 40 and from the water drain hole 40C in the turned-up portion 40B. Therefore, it is possible to prevent water from collecting in the connector duct 40.

As shown in FIG. 6, in both the first example and the second example, the connector duct 40 includes a first halfway portion 40D that extends downwardly from the outer end 32A and a second halfway portion 40E that extends either in the left direction or in the right direction (in FIG. 6, in the right direction) from a lower end of the first halfway portion 40D and that is connected to the turned-up portion 40B. In the first example, the turned-up portion 40B is positioned between the upper portion 40A and the second halfway portion 40E (see FIG. 4), and, in the second example, the upper portion 40A is also the second halfway portion 40E (see FIG. 5).

The vessel 1 includes an exhaust duct 45 that is connected to another vent hole 6B (in the present preferred embodiment, vent hole 6B on the left side) that is different from the vent hole 6B connected to the outer end 32A and that is drawn around in the vessel body 2. The exhaust duct 45 discharges air in the vessel body 2 outwardly from the vessel body 2. The exhaust duct 45 preferably has a shape that is different from that of the connector duct 40, for example, so as to be laterally symmetrically with the connector duct 40, and overlaps the connector duct 40 in a front view. The length of the connector duct 40 may differ from that of the exhaust duct 45. As thus described, the vessel 1 includes the two ducts 40 and 45 that differ from each other in shape.

Air outside the vessel body 2 is taken into the air intake duct 32 from the entrance 32B, and is then guided to the opening 33A by the guide duct 33 (see the dashed arrows in FIG. 4 and FIG. 5). The opening 33A faces the air intake port 31A of the air intake box 31 and so as to be located near the air intake port 31A, and therefore air that has reached the opening 33A swiftly flows into the air intake port 31A, and is taken into the air intake box 31, and is supplied to the engine 3. As thus described, air outside the vessel body 2 reaches the air intake port 31A of the air intake box 31 without being exposed to hot air generated by the heat of the engine 3 in the vessel body 2 as much as possible, and hence is supplied to the engine 3 in a low-temperature state that is substantially no different from the outside air temperature. As a result, it is possible to reduce or prevent the temperature of the intake air of the engine 3 from being increased even if the vessel 1 is being used in a high-temperature environment such as summer time. These effects are also be obtained in the third to seventh examples described later.

As shown in FIG. 7, the air intake box 31 may be provided with a flange 46 that projects from the periphery of the air intake port 31A. The flange 46 preferably has the shape of a plate and is disposed so that a thickness direction thereof corresponds to the front-rear direction, and surrounds the air intake port 31A. This makes it possible for the flange 46 to reduce or prevent hot air around the engine 3 from flowing forwardly and from entering the air intake port 31A of the air intake box 31. Therefore, it is possible to further reduce or prevent the temperature of intake air of the engine 3 from being increased.

The whole area of the outer surface including the front surface 31B and the right surface 31C of the air intake box 31 may be covered with a heat insulator 47 (which is shown by dots in FIG. 7 for clarification). In this case, the air intake box 31 is insulated from the surrounding ambient hot air by the heat insulator 47, and therefore it is possible to reduce or prevent the temperature of air supplied to the engine 3 from being increased in the air intake box 31. This makes it possible to further reduce or prevent the temperature of intake air of the engine 3 from being increased. The heat insulator 47 is applicable not only to the first and second examples but also to the third to seventh examples described below.

The vessel 1 may include a heat shield 48. The heat shield 48 is made of, for example, resin, and preferably has the shape of a sheet. In the present preferred embodiment, the heat shield 48 is disposed along a boundary between the air intake box 31 and the engine 3 as shown in FIG. 4 and FIG. 5. A lower end 48A of the heat shield 48 is connected to the hull 5, and an upper end 48B of the heat shield 48 is connected to the deck 6. As a result, the heat shield 48 partitions the internal space 2A of the vessel body 2 into a first region 2B that is an engine room where which the engine 3 is disposed and a second region 2C where the air intake box 31 and the opening 33A are disposed in the internal space 2A, and thermally shields the space between the first region 2B and the second region 2C.

Therefore, it is possible to prevent air that has been taken in from outside the vessel body 2 and that has reached the opening 33A through the inside of the guide duct 33 from entering the first region 2B. This makes it possible to reduce or prevent air taken in from outside the vessel body 2 from being heated by the heat of the engine 3 and then reaching the air intake port 31A of the air intake box 31. Additionally, the heat shield 48 makes it possible to prevent the hot air of the first region 2B from entering the second region 2C, and therefore it is possible to reduce or prevent an increase in temperature of the second region 2C. Therefore, air that has reached the opening 33A reaches the air intake port 31A without being influenced by heat in the first region 2B and the second region 2C as much as possible, and is supplied to the engine 3 from the air intake box 31.

Even only the existence of the heat shield 48 makes it possible to reduce or prevent the temperature of intake air of the engine 3 from being increased. In addition, if the heat shield 48 is applied to the first to seventh examples, it is possible to further reduce or prevent the temperature of intake air of the engine 3 from being increased.

Figure 8:
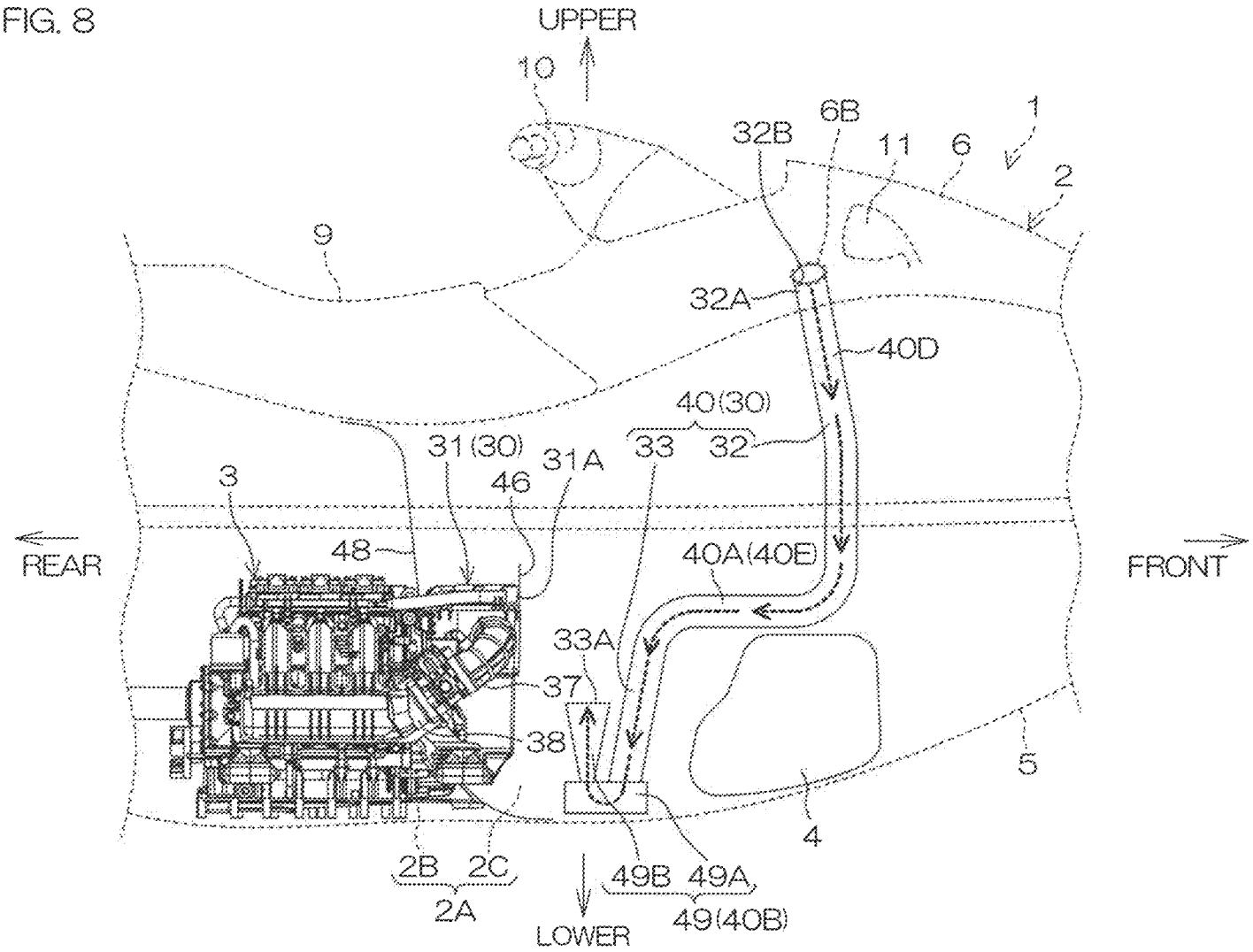
FIG. 8 is a side view of the engine and an air intake structure according to a third example of a preferred embodiment of the present invention.

The third example shown in FIG. 8 is a modification of the first and second examples. An attachment 49 is provided at a downstream end of the connector duct 40. The attachment 49 includes, for example, a box-shaped base 49A and a circular cylindrical exit portion 49B that protrudes upwardly from the base 49A. The internal space of the base 49A and the internal space of the exit portion 49B communicate with each other, and define the internal space of the downstream end of the connector duct 40. The exit portion 49B is preferably tapered such that the cross-sectional area of its flow passage becomes larger as it extends upwardly. The opening 33A is located at an upper end of the exit portion 49B, and opposes the air intake port 31A of the air intake box 31 from below. The downstream end of the connector duct 40 includes the turned-up portion 40B, which extends downwardly from the upper portion 40A and is then upwardly turned toward the opening 33A by the attachment 49. The attachment 49 makes it possible to freely set the position of the opening 33A.

In the third example, air outside the vessel body 2 is taken into the air intake duct 32 from the entrance 32B, and is then guided to the opening 33A by the guide duct 33 and the attachment 49, and is discharged upwardly from the opening 33A (see the dashed arrows in FIG. 8). The opening 33A is directed toward the air intake port 31A of the air intake box 31, and therefore air that has reached the opening 33A reaches the air intake port 31A immediately, and is taken into the air intake box 31 and supplied to the engine 3.

Figure 9:
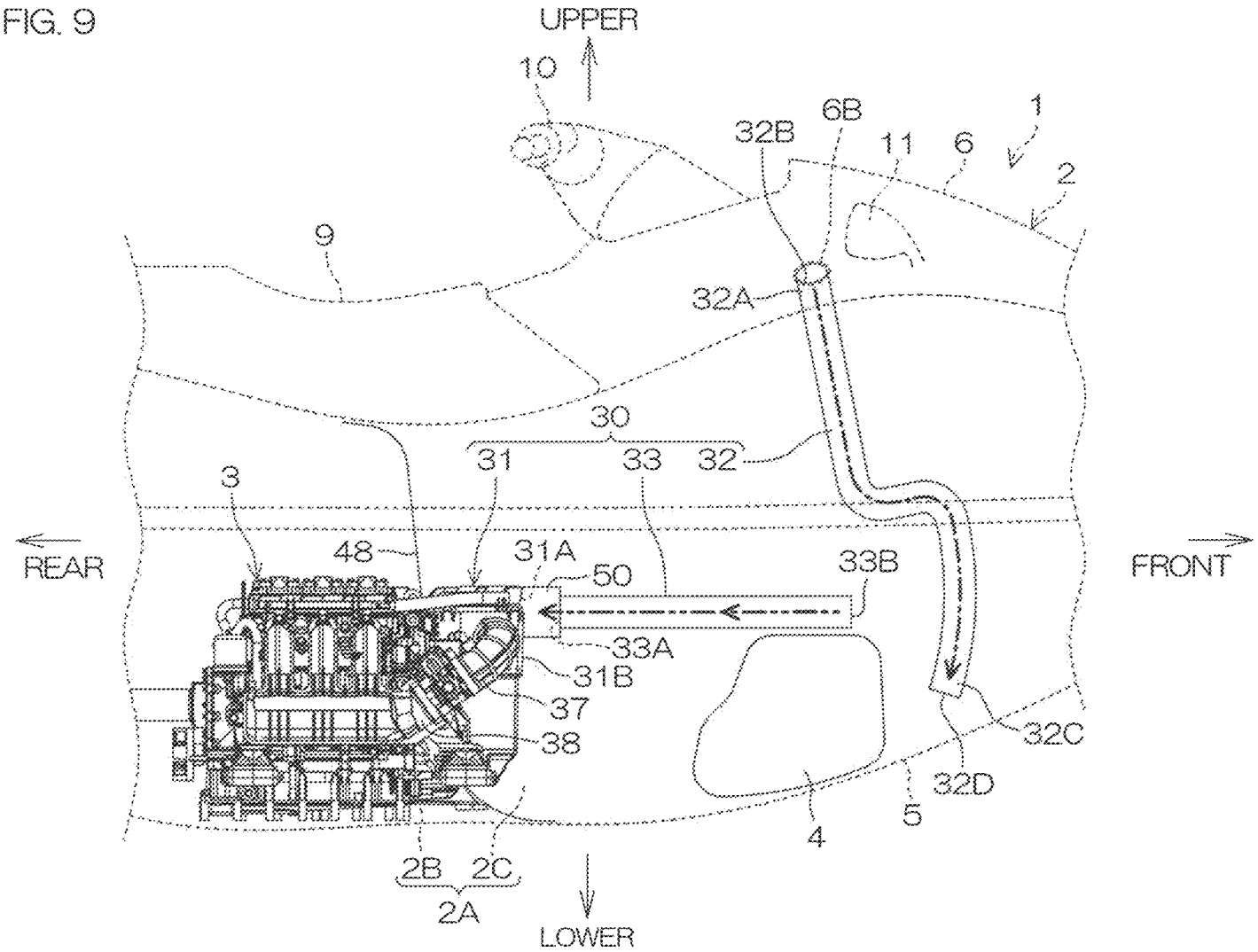
FIG. 9 is a side view of the engine and an air intake structure according to a fourth example a preferred embodiment of the present invention.

In the fourth example shown in FIG. 9, unlike the first to third examples, the air intake duct 32 and the guide duct 33 are preferably not integral with each other. The air intake duct 32 includes an inner end 32C located on the side opposite to the outer end 32A, and takes air into the inner end 32C from the outer end 32A. The inner end 32C includes an outlet 32D that allows air taken into the inner end 32C from the outer end 32A to flow outside the air intake duct 32 (i.e., flow to a region outside the air intake duct 32 in the internal space 2A). The outlet 32D is open to the internal space 2A. The inner end 32C is disposed in front of the fuel tank 4, and the outlet 32D is directed downwardly so as to oppose an inner bottom surface of the hull 5. A front end of the guide duct 33 includes an intake port 33B that takes in air that has been taken into the vessel body 2 by the air intake duct 32. In a space above the fuel tank 4, the guide duct 33 extends rearwardly from the intake port 33B to the opening 33A. The intake port 33B is not connected to the inner end 32C, and is adjacent to the inner end 32C from behind. Therefore, the guide duct 33 is spaced apart from the air intake duct 32.

A box-shaped attachment 50 is disposed between the front surface 31B of the air intake box 31 and a rear end of the guide duct 33, and is connected to the air intake box 31 and to the guide duct 33. Therefore, the guide duct 33 is connected to the air intake box 31 through the attachment 50. The internal space of the attachment 50 leads to the internal space of the rear end of the guide duct 33 from behind, and leads to the air intake port 31A of the air intake box 31 from the front. The opening 33A of the guide duct 33 opposes the air intake port 31A from the front through the internal space of the attachment 50.

In the fourth example, air outside the vessel body 2 is taken into the air intake duct 32 from the entrance 32B, and then flows from the outlet 32D to a region in front of the fuel tank 4 in the vessel body 2 (see the arrow having the alternate long and short dashed line in FIG. 9). Air in this region is taken into the guide duct 33 from the intake port 33B, and is guided to the opening 33A, and is guided from the opening 33A to the air intake port 31A through the inside of the attachment 50 (see the arrow having the alternate long and two short dashed line in FIG. 9). As a result, air that has been taken in from outside the vessel body 2 and that has reached the inner end 32C of the air intake duct 32 is taken into the guide duct 33, and then reaches the air intake port 31A without being exposed to hot air generated by the heat of the engine 3, and is supplied to the engine 3. As a result, it is possible to reduce or prevent the temperature of intake air of the engine 3 from being increased.

The length of the guide duct 33 is able to be changed to have an arbitrary length. If the guide duct 33 is lengthened so that the intake port 33B becomes close to the inner end 32C of the air intake duct 32, it is possible to efficiently take in air, which has been taken in from outside the vessel body 2 by the air intake duct 32, into the intake port 33B and supply it to the engine 3.

Figure 10:
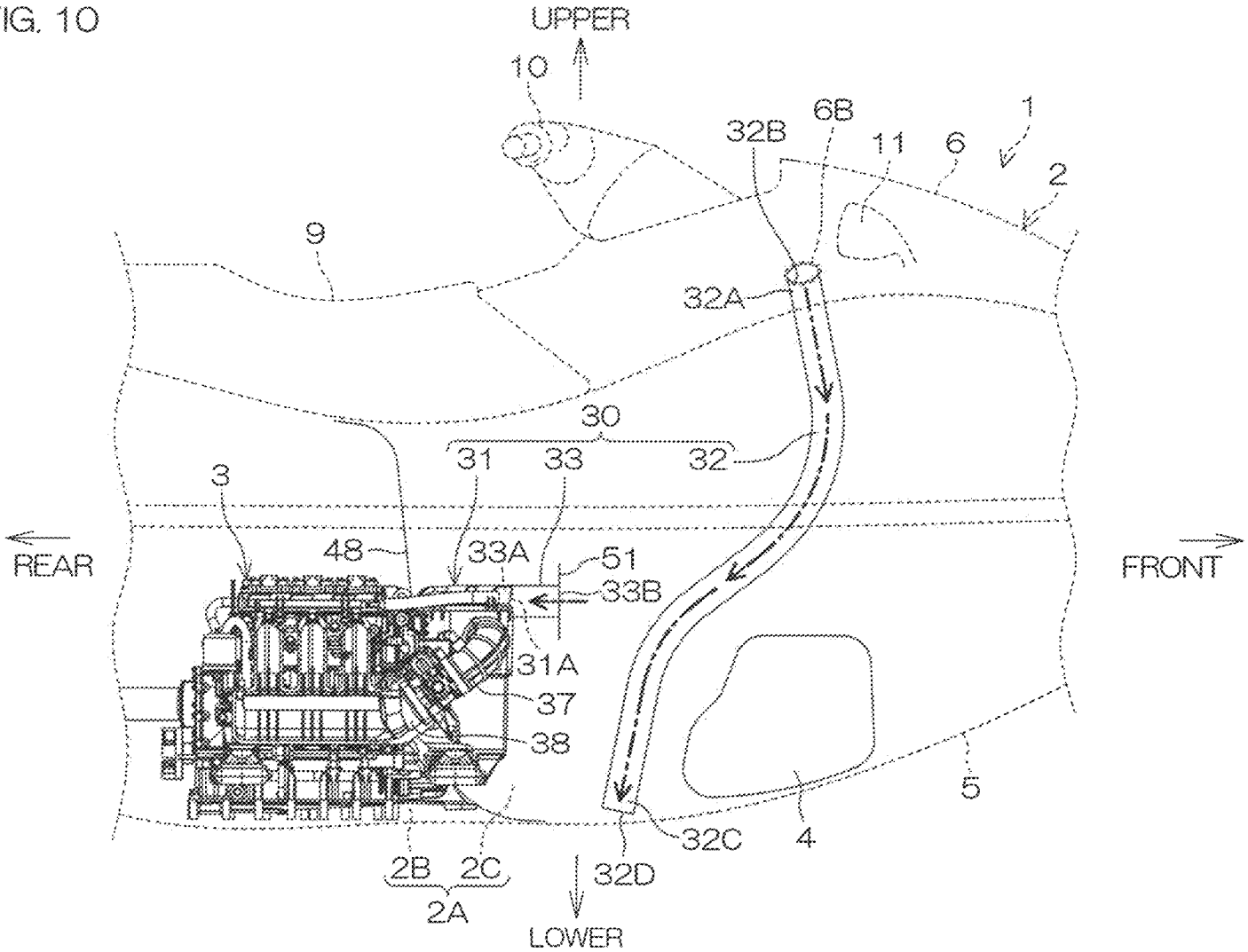
FIG. 10 is a side view of the engine and an air intake structure according to a fifth example of a preferred embodiment of the present invention.

The fifth example shown in FIG. 10 is a modification of the fourth example. In the fifth example, the inner end 32C of the air intake duct 32 is preferably disposed between the fuel tank 4 and the air intake box 31 in the internal space 2A of the vessel body 2. The attachment 50 (see FIG. 9) may be excluded, and the opening 33A of the guide duct 33 is preferably connected directly to the air intake port 31A of the air intake box 31.

In the fifth example, air outside the vessel body 2 is taken into the air intake duct 32 from the entrance 32B of the outer end 32A, and then flows into a region between the fuel tank 4 and the air intake box 31 in the vessel body 2 from the outlet 32D of the inner end 32C of the air intake duct 32 (see the arrow having the alternate long and short dashed line in FIG. 10). Air in this region is taken into the guide duct 33 from the intake port 33B, and is guided to the opening 33A (see the arrow having the alternate long and two short dashed line in FIG. 10). The air intake port 31A of the air intake box 31 receives air that has reached the opening 33A, and therefore air that has reached the opening 33A is immediately taken into the air intake box 31 from the air intake port 31A, and is supplied to the engine 3 as described above.

The guide duct 33 is preferably provided with a flange 51 that projects from the periphery of the intake port 33B. The flange 51 preferably has the shape of a plate and is disposed so that a thickness direction thereof corresponds to the front-rear direction, and surrounds the intake port 33B. In this case, it is possible for the flange 51 to reduce or prevent hot air around the engine 3 from flowing forwardly and from entering the intake port 33B of the guide duct 33. This makes it possible to further reduce or prevent the temperature of intake air of the engine 3 from being increased.

Figure 11:
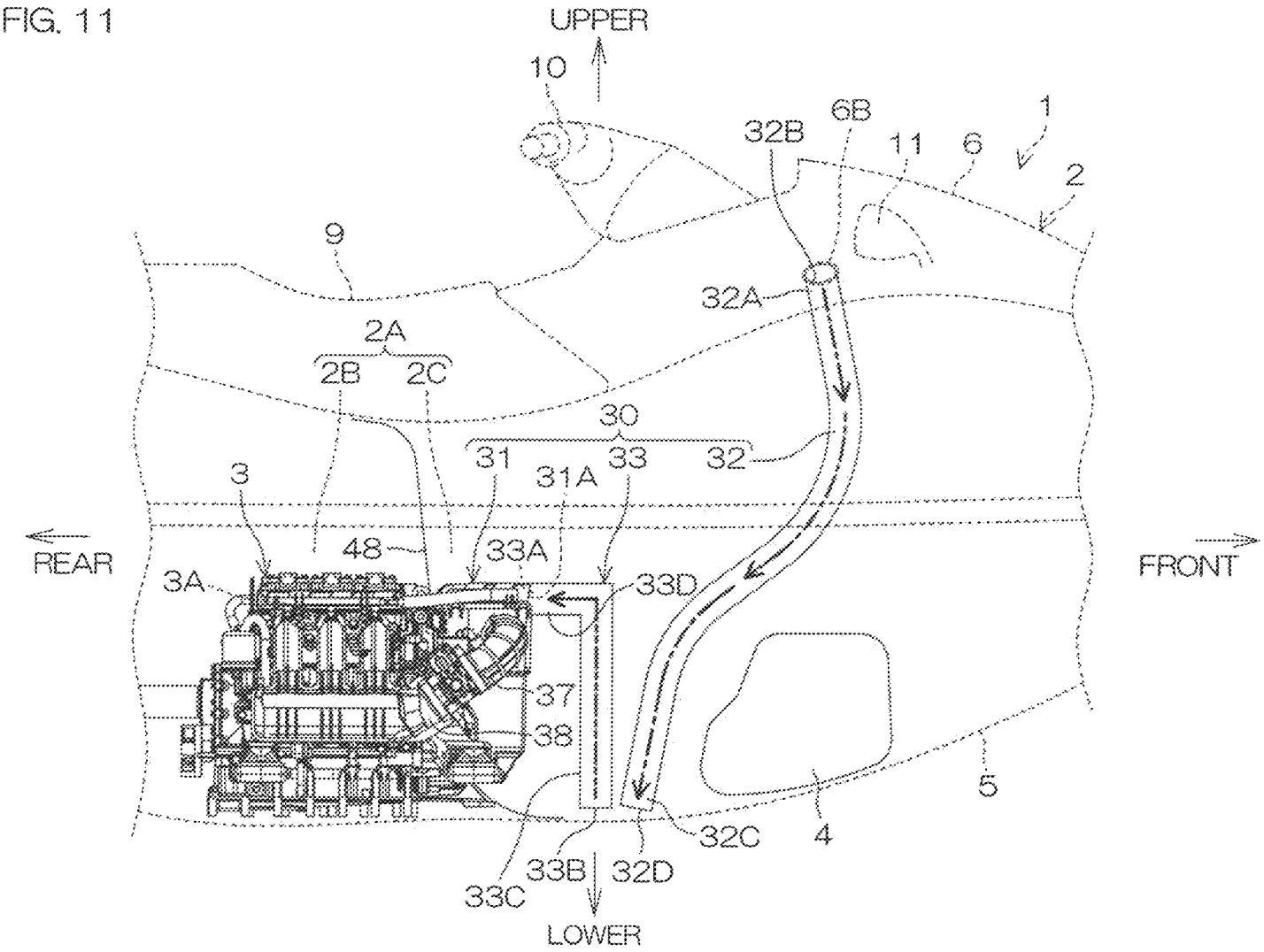
FIG. 11 is a side view of the engine and an air intake structure according to a sixth example of a preferred embodiment of the present invention.

The sixth example shown in FIG. 11 is a modification of the fifth example. In this example, the guide duct 33 includes a first duct 33C that is disposed between the fuel tank 4 and the air intake box 31 and that extends in the up-down direction. The guide duct 33 additionally includes an integral second duct 33D that extends rearwardly from an upper end of the first duct 33C and that is connected to the air intake port 31A. The intake port 33B is located at a lower end of the first duct 33C, and opens downwardly. The intake port 33B is disposed below the combustion chamber 3A which is disposed at the upper portion of the engine 3. The opening 33A is located at a rear end of the second duct 33D, and faces the air intake port 31A from the front.

In the sixth example, air outside the vessel body 2 is taken into the air intake duct 32 from the entrance 32B, and then flows from the outlet 32D into a region between the fuel tank 4 and the air intake box 31 in the vessel body 2 (see the arrow having the alternate long and short dashed line in FIG. 11). Air in this region is taken into the guide duct 33 from the intake port 33B, and flows through the first duct 33C and the second duct 33D, in this order, and is guided to the opening 33A (see the arrow having the alternate long and two short dashed line in FIG. 11). The opening 33A is directed to the air intake port 31A of the air intake box 31, and therefore air that has reached the opening 33A is immediately taken into the air intake box 31 from the air intake port 31A, and is supplied to the engine 3.

Cold air is likely to collect in a region below the combustion chamber 3A that is a heat source of the engine 3, and therefore this region is lower in temperature than the surroundings of the combustion chamber 3A. Therefore, air that has been taken in from outside the vessel body 2 and that has reached this region reaches the air intake box 31 from the intake port 33B through the inside of the guide duct 33 without being influenced by the heat of the engine 3 as much as possible.

Figure 12:
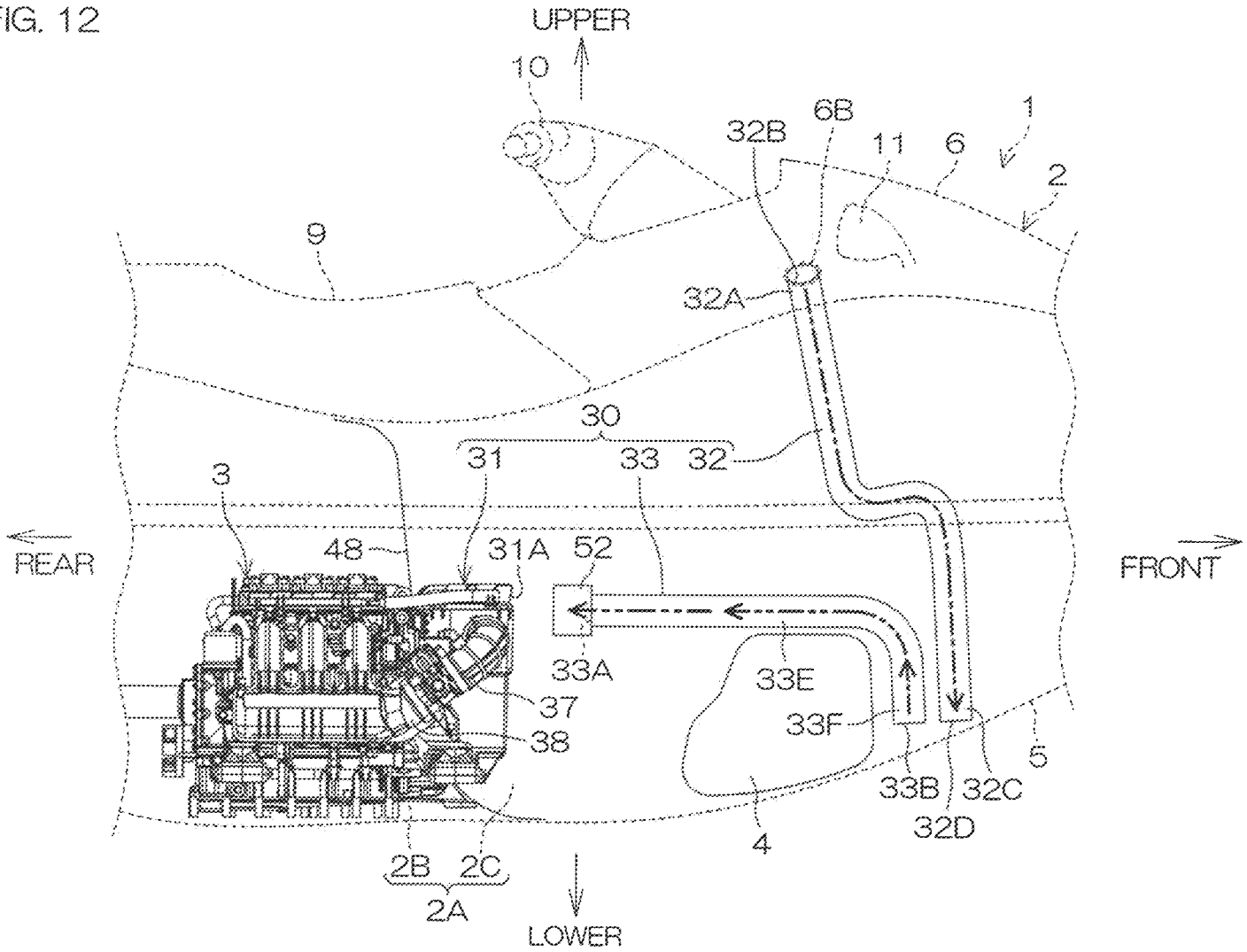
FIG. 12 is a side view of the engine and an air intake structure according to a seventh example of a preferred embodiment of the present invention.

In the seventh example shown in FIG. 12, unlike the first to sixth examples, the guide duct 33 is spaced apart from each of the air intake box 31 and the air intake duct 32 between the air intake box 31 and the inner end 32C of the air intake duct 32. Therefore, the guide duct 33, the air intake box 31, and the air intake duct 32 are independent of each other, and therefore the degree of freedom in designing and disposing these components is high. The inner end 32C is disposed in front of the fuel tank 4 in the internal space 2A of the vessel body 2. The guide duct 33 includes an integral upper portion 33E that is disposed at a higher position than the fuel tank 4 and that extends in the front-rear direction and an integral front portion 33F that bends from a front end of the upper portion 33E and that extends downwardly and that is disposed in front of the fuel tank 4. The front portion 33F may be excluded. The opening 33A is located at a rear end of the upper portion 33E. A box-shaped attachment 52 is connected to a rear end of the upper portion 33E. The attachment 52 faces the air intake port 31A of the air intake box 31 from the front with an interval of, for example, about 10 mm therebetween. A rear surface of the attachment 52 is open, and the opening 33A of the guide duct 33 opposes the air intake port 31A from the front through the internal space of the attachment 52.

In the seventh example, air outside the vessel body 2 is taken into the air intake duct 32 from the entrance 32B, and then flows from the outlet 32D into a region in front of the fuel tank 4 in the vessel body 2 (see the arrow having the alternate long and short dashed line in FIG. 12). Air in this region is taken into the guide duct 33 from the intake port 33B, and is guided to the opening 33A (see the arrow having the alternate long and two short dashed line in FIG. 12), and is guided to the air intake port 31A through the attachment 52.

The guide duct 33 including the upper portion 33E is drawn around toward a higher position than the fuel tank 4 in the vessel body 2. This makes it possible to bring the opening 33A of the guide duct 33 close to the air intake port 31A of the air intake box 31. Therefore, air that has reached the opening 33A flows into the air intake box 31 from the air intake port 31A, and is supplied to the engine 3 without being influenced by hot air in the vessel body 2 as much as possible. Therefore, it is possible to reduce or prevent the temperature of intake air of the engine 3 from being increased.

Other Preferred Embodiments

Although preferred embodiments of the present invention have been described above, the present invention is not restricted to the contents of the preferred embodiments and various modifications are possible within the scope of the present invention.

For example, if the engine 3 is disposed in the vessel body 2, the vessel 1 may include exclude the jet pump 12 as a propulsive-force generating mechanism. A screw that is connected to a crankshaft (not shown) of the engine 3 and that is disposed outside the vessel body 2 may be used as the propulsive-force generating mechanism.

Figure 13:
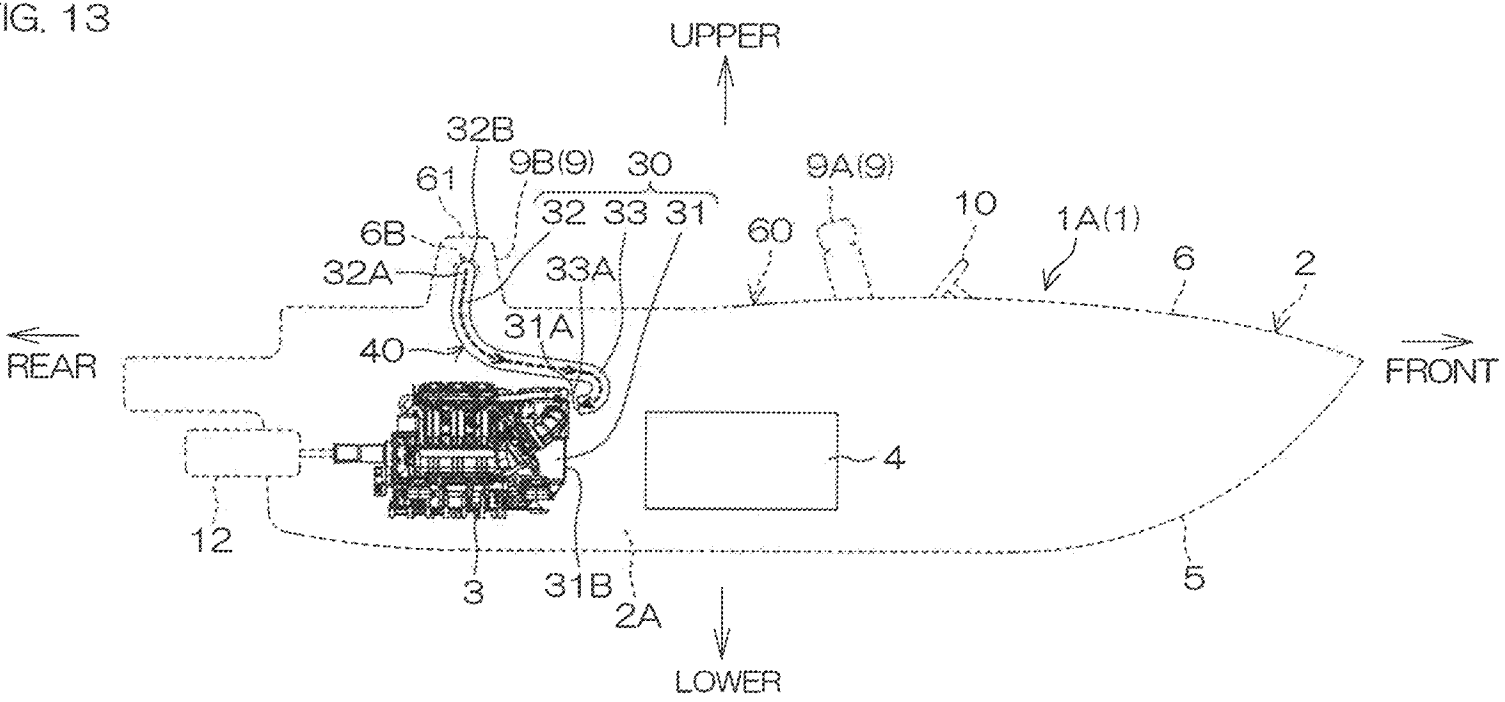
FIG. 13 is a schematic view of a vessel according to another preferred embodiment of the present invention.

FIG. 13 is a schematic view of a vessel 1 according to another preferred embodiment. Another example of the vessel 1 is a jet boat 1A shown in FIG. 13. In FIG. 13, the same numerals are given to components that are equivalent in function to the components described above, and a detailed description of those components is omitted. The vessel body 2 of the jet boat 1A includes the hull 5 and the deck 6 disposed above the hull 5. A cockpit 60 is provided at a central or substantially central portion of the deck 6 in the front-rear direction. For example, a seat 9A for a vessel operator and the steering handle 10 are disposed in a front region in the cockpit 60, and a passenger seat 9B is disposed in a rear region in the cockpit 60. The deck 6 includes a projection 61 that protrudes upwardly and that may be used as a portion of a backrest of the passenger seat 9B. The projection 61 is hollow, and the internal space of the projection 61 includes a portion of the internal space 2A of the vessel body 2. The projection 61 includes a vent hole 6B as described above.

The engine 3 is disposed in a region deviated rearwardly in the internal space 2A of the vessel body 2, and, for example, is positioned below the projection 61. The jet pump 12 is disposed at the rear portion of the vessel body 2, and generates a propulsive force by the driving force of the engine 3. The fuel tank 4 is disposed at a more forward position than the engine 3 in the internal space 2A.

The air intake structure 30 is also included in the jet boat 1A. In the air intake structure 30 in this case, the air intake box 31 is attached to the engine 3 from the front in a region between the engine 3 and the fuel tank 4 in the internal space 2A. The outer end 32A of the air intake duct 32 is disposed in the projection 61 of the deck 6, and the entrance 32B of the outer end 32A is connected to the vent hole 6B of the projection 61. The air intake duct 32 is drawn around forwardly from the outer end 32A in a region higher than the engine 3 in the internal space 2A. The guide duct 33 extends forwardly through the upper space above the air intake box 31, and bends downwardly in the internal space 2A. The opening 33A disposed at the lower end of the guide duct 33 opposes the air intake port 31A located at the front surface 31B of the air intake box 31 from the front.

In the jet boat 1A, air outside the vessel body 2 is taken in by the air intake duct 32, and is then guided to the opening 33A by the guide duct 33 (see the dashed arrow in FIG. 13). Air that has been guided to the opening 33A swiftly flows into the air intake port 31A, and is taken into the air intake box 31 and supplied to the engine 3. Therefore, likewise, in the jet boat 1A, air outside the vessel body 2 reaches the air intake port 31A of the air intake box 31 without being exposed to hot air generated by the heat of the engine 3, and hence is supplied to the engine 3 in a low-temperature state that is substantially no different from the outside air temperature.

Likewise, in the air intake structure 30 of the jet boat 1A, the air intake duct 32 and the guide duct 33 are preferably integral with each other as the connector duct 40 in the same way as in the first and second examples. The attachment 49 (see FIG. 8) of the third example may be used. As in the fourth to sixth examples, the guide duct 33 may be spaced apart from the air intake duct 32, and, in this case, the attachment 50 (see FIG. 9) may be used. As in the seventh example, the guide duct 33 may be spaced apart from each of the air intake box 31 and the air intake duct 32. Additionally, the flange 46, the heat insulator 47, and the heat shield 48 (see FIG. 7) may be used. In the jet boat 1A, unlike that of FIG. 13, the air intake duct 32 and the guide duct 33 may have same layout as in FIGS. 1 to 12 if the outer end 32A of the air intake duct 32 is disposed at a more forward position than the engine 3.

It is to be understood that features of two or more of the various preferred embodiments described above may be combined.

The present application claims priority to Japanese Patent Application No. 2016-164977 filed on Aug. 25, 2016 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, thus, is to be determined solely by the following claims.

What is claimed is:

1. A vessel comprising:

a vessel body including a hull and a deck, the hull defining a vessel bottom, and the deck being disposed above the hull;

an engine contained in the vessel body;

an air intake box attached to the engine and including an air intake port and that supplies air taken in from the air intake port to the engine;

an air intake duct including an outer end connected to the deck; and a guide duct including an opening that opposes the air intake port and that guides air taken in from outside the vessel body by the air intake duct to the opening.

2. The vessel according to claim 1, further comprising a connector duct that includes the air intake duct and the guide duct; wherein the connector duct passes through an inside of the vessel body from the outer end and opposes the air intake port.

3. The vessel according to claim 2, further comprising an exhaust duct; wherein the connector duct and the exhaust duct differ from each other in shape.

4. The vessel according to claim 3, further comprising a fuel tank disposed at a more forward position than the air intake box in the vessel body and that stores fuel for the engine; wherein the connector duct includes an upper portion and a turned-up portion;

the upper portion is disposed at a higher position than the fuel tank; and the turned-up portion is disposed at a more forward position than the fuel tank or disposed between the air intake box and the fuel tank, and the turned-up portion extends downwardly from the upper portion and then turns upwardly.

5. The vessel according to claim 4, wherein the turned-up portion includes a water drain hole that opens downwardly.

6. The vessel according to claim 2, further comprising a flange that projects from a periphery of the air intake port of the air intake box.

7. The vessel according to claim 1, wherein the air intake duct includes an inner end disposed in the vessel body and takes air into the inner end from the outer end; and the guide duct is connected to the air intake port of the air intake box, is spaced apart from the air intake duct, and includes an intake port that takes in air that has been taken into the vessel body by the air intake duct.

8. The vessel according to claim 7, wherein the intake port is disposed at a lower position than a combustion chamber of the engine.

9. The vessel according to claim 7, further comprising a flange that projects from a periphery of the intake port of the guide duct.

10. The vessel according to claim 1, wherein the air intake duct includes an inner end disposed in the vessel body and that takes air into the inner end from the outer end; and the guide duct is spaced apart from the air intake box and from the air intake duct between the air intake box and the inner end.

11. The vessel according to claim 7, further comprising a fuel tank disposed at a more forward position than the air intake box in the vessel body and that stores fuel for the engine; wherein the guide duct is disposed at a higher position than the fuel tank.

12. The vessel according to claim 1, further comprising a heat shield that thermally shields a space between a first region where the engine is disposed in the vessel body and a second region where the air intake box and the opening are disposed in the vessel body.

13. The vessel according to claim 1, further comprising a heat insulator with which the air intake box is covered.

14. The vessel according to claim 1, wherein the vessel is a jet propulsion watercraft including a jet pump that generates a jet propulsion force by sucking in and jetting out water by a driving force of the engine.

15. The vessel according to claim 1, wherein the opening opposes the air intake port so that the air in the guide duct flows from the opening into the air intake port.

* * * * *